US005085316A

United States Patent [19]

Pearce et al.

[11] Patent Number: 5,085,316

[45] Date of Patent: Feb. 4, 1992

[54] BLANK FOR PACKAGE AND ASSEMBLED PACKAGE FOR DISPLAY

[75] Inventors: Scott C. Pearce, Cincinnati; William H. Perkins, Oxford; Daniel Brod; Stan Brod, both of Cincinnati, all of Ohio

[73] Assignee: The Drackett Company, Cincinnati, Ohio

[21] Appl. No.: 666,288

[22] Filed: Mar. 8, 1991

[51] Int. Cl.[5] ..... B65D 65/12; B65D 5/02

[52] U.S. Cl. ..... 206/223; 206/361; 206/362.4

[58] Field of Search ..... 206/223, 361, 362.4

[56] References Cited

U.S. PATENT DOCUMENTS

| | | | |
|---|---|---|---|
| 136,026 | 2/1873 | Bronson | 206/361 |
| 2,491,663 | 12/1949 | Hultin | 206/223 X |
| 3,241,738 | 3/1966 | Freiman | 206/223 X |
| 4,053,050 | 10/1977 | Forbes, Jr. et al. | 206/362.4 |

*Primary Examiner*—William I. Price

*Attorney, Agent, or Firm*—Charles Zeller

[57] ABSTRACT

A unitary blank for erection into a package for display and also the erected package which holds, for example, a disassembled mop including a mop head and a mop handle. One embodiment of the blank, and by extension the package, comprises a rear panel, a first side panel, a front panel, a second side panel, and a side flap bondable to the inner surface of the second side panel, with the panels and the flap being foldable about lateral fold lines, so as to define a compartment having opposed openings. The rear panel defines an aperture for receiving and holding the flanges of the mop head. The blank includes folds and cuts for a pocket integral with the front panel and one of the side panels in which will be positioned the mop handle within the erected package. A top flap integral with the rear panel extends above the front panel and has a hole for receiving a hook of a display rack. The blank includes folds and cuts for a stop for preventing lateral movement of the sponge head relative to the erected package.

28 Claims, 8 Drawing Sheets

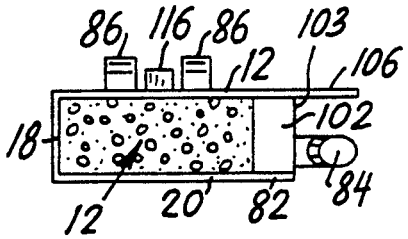
FIG. 5A
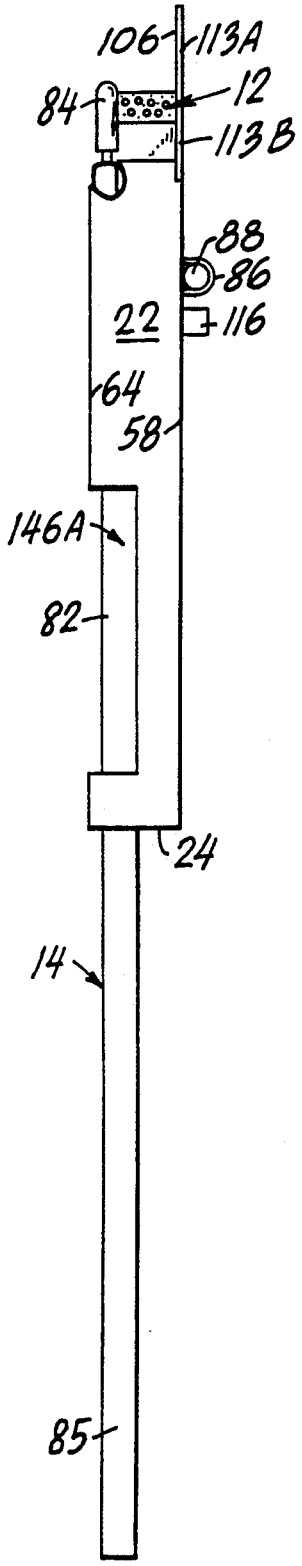
FIG. 10
FIG. 7
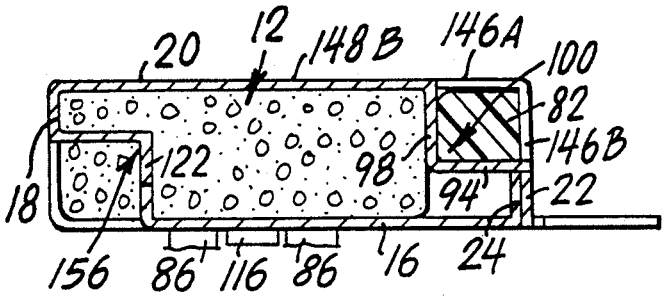
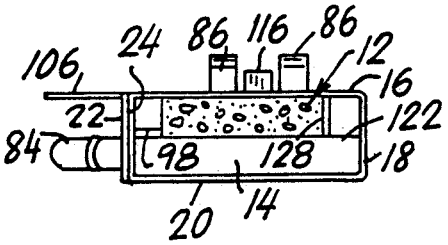
FIG. 11

BLANK FOR PACKAGE AND ASSEMBLED PACKAGE FOR DISPLAY

FIELD OF THE INVENTION

This invention relates to a blank that is erected to form a package for holding and displaying a commercial product, the package being especially useful for holding a disassembled short mop. The invention also relates to the erected package.

BACKGROUND OF THE INVENTION

A disassembled short mop comprising a sponge head and a handle can be assembled into a unitary mop by inserting a shaft at the head side of the handle into cylindrical holes in flanges mounted to the mop head. The mop, when disassembled into its two component parts, can be fitted into a package that is better suited to handling and retail display than a package holding an assembled mop.

The short mop is best promoted for sale by displaying the package holding the disassembled components from a sales rack, in particular from a hook thereon. In addition, the package should be such that some portion of both components of the disassembled mop can be viewed by customers.

While developed for use with the above-described mop, the blank and package of the present invention would also be suitable for holding and displaying a variety of products—tools, toys, cooking utensils and the like. In this regard, it is not essential that the goods to be held or displayed require assembly for use. Thus, the goods may be part of a system for cooperative use by the purchaser.

SUMMARY OF THE INVENTION

Accordingly, it is an object of this invention to provide a unitary blank suitable for erection to form a package adapted for securely holding an essentially rectilinear first article and an elongate second article, for example, a disassembled mop head and mop handle. The blank can be mass produced by automatic cutting or punching of material, such as plastic or paper such as cardboard and can be erected into a finished package quickly and with a minimum of labor.

It is another object of this invention to provide a package securely holding, e.g., a disassembled mop head and mop handle for an assembled mop that is capable of preventing the disassembled components from undue movement relative to the package and especially from falling out of the package either during its handling or when it is hanging from the display rack.

It is a further object of the present invention to provide the package being adapted to hold the two components with features that allow customers to view at least some portion of both components while the package is hung from a sales rack.

In accordance with these and other objects which will be set forth in the course of this application, there is provided a unitary blank for erection into a package for display, the package being adapted to hold two components including an essentially rectilinear first component and an essentially elongate second component, the blank comprising a rear panel, a first side panel, a front panel, a second side panel, and a side flap bondable to the inner surface of the second side panel, with the panels and the side flap being foldable about lateral fold lines that extend in the top-to-bottom direction of the blank as the erected package would be hung during display. The front and rear panels and the first and second side panels define a compartment having opposed openings. The rear panel defines an aperture positioned transversely off-center relative to one of the side edges of the rear panel, which aperture receives retention means associated with the first component, e.g., a pair of spaced flanges extending from the rear surface of the first component, whereby the first component is essentially prevented from lateral movement relative to the opposed component openings and from transverse movement relative to the side panels when said first component is positioned in the assembled package. The blank includes folds and cuts for a pocket within the compartment and integral with the front panel and one of the side panels in which the second component will be positioned in the erected package so as both to hold the second component and to maintain it against the inner surfaces of the front panel and the one side panel in areas other than the pocket. A top portion integral with the rear panel extends above the front panel and has a hole for receiving a hook of a display rack. Another embodiment of the blank includes a second top portion that registers with the top portion of the rear panel. The blank optionally includes folds and cuts for a pocket integral with the front panel and the other of the side panels for further preventing downward movement of the first component relative to the erected package.

The invention also includes the package itself in its erected mode from the blank which includes a front wall and an opposed rear wall, the opposed first and second side walls being joined to the front and rear walls. The front, the rear, and the first and second side walls define a compartment having opposed openings wherein at least a portion of the first component and at least a portion of the second component are positioned. The rear wall includes a top portion defining opening means for receiving a hook of a display rack, and also defines aperture means for receiving and holding retention means associated with the first component whereby the first component is further prevented from lateral movement relative to the opposed compartment openings and transverse movement relative to the side walls. A pocket within the compartment and integral with the front wall and one of the side walls receives a portion of the second compartment so that the second compartment is held in contact with the inner surfaces of the front wall and the one side wall. When the second component is received by the pocket and the first component is received by the compartment, the first component is in cooperative abutting relationship with the first, front and rear side walls and a portion of said second component, and the second component is in further cooperative abutting relationship with the front and second side walls, such abutting cooperative relationships substantially preventing transverse and lateral movement of the components relative to the package.

The one side wall also includes means for further preventing lateral movement of the second component relative to the opposed openings.

PRIOR ART

The following patents describe unitary blanks for relating to erected packages for holding products for display: U.S. Pat. No. 4,106,615 issued Aug. 15, 1978 to Hiroshi; U.S. Pat. No. 3,055,492 issued Sept. 25, 1962 to Franklin; and U.S. Pat. No. 2,092,359 issued July 21, 1942 to Ringler.

BRIEF DESCRIPTION OF THE DRAWINGS

FIG. 5A is a top view taken through line 5A—5A of FIG. 5;

FIG. 7 is a sectional view taken through line 7—7 in FIG. 5;

FIG. 10 is a side elevational view of the package taken through line 10—10 in FIG. 9; and FIG. 11 is a bottom plan view of the package taken through line 11—11 in FIG. 9.

DESCRIPTION OF THE PREFERRED EMBODIMENTS

Although the blank and the package will be described below with respect to a disassembled mop, it is to be understood that the blank and the package of the present invention are suitable with respect to any two-component product comprising a generally rectilinear work element and a generally elongate work element, for retention within the package.

Reference is now made to the drawings in which the same or similar elements are indicated by the same numerals.

Figure 1:
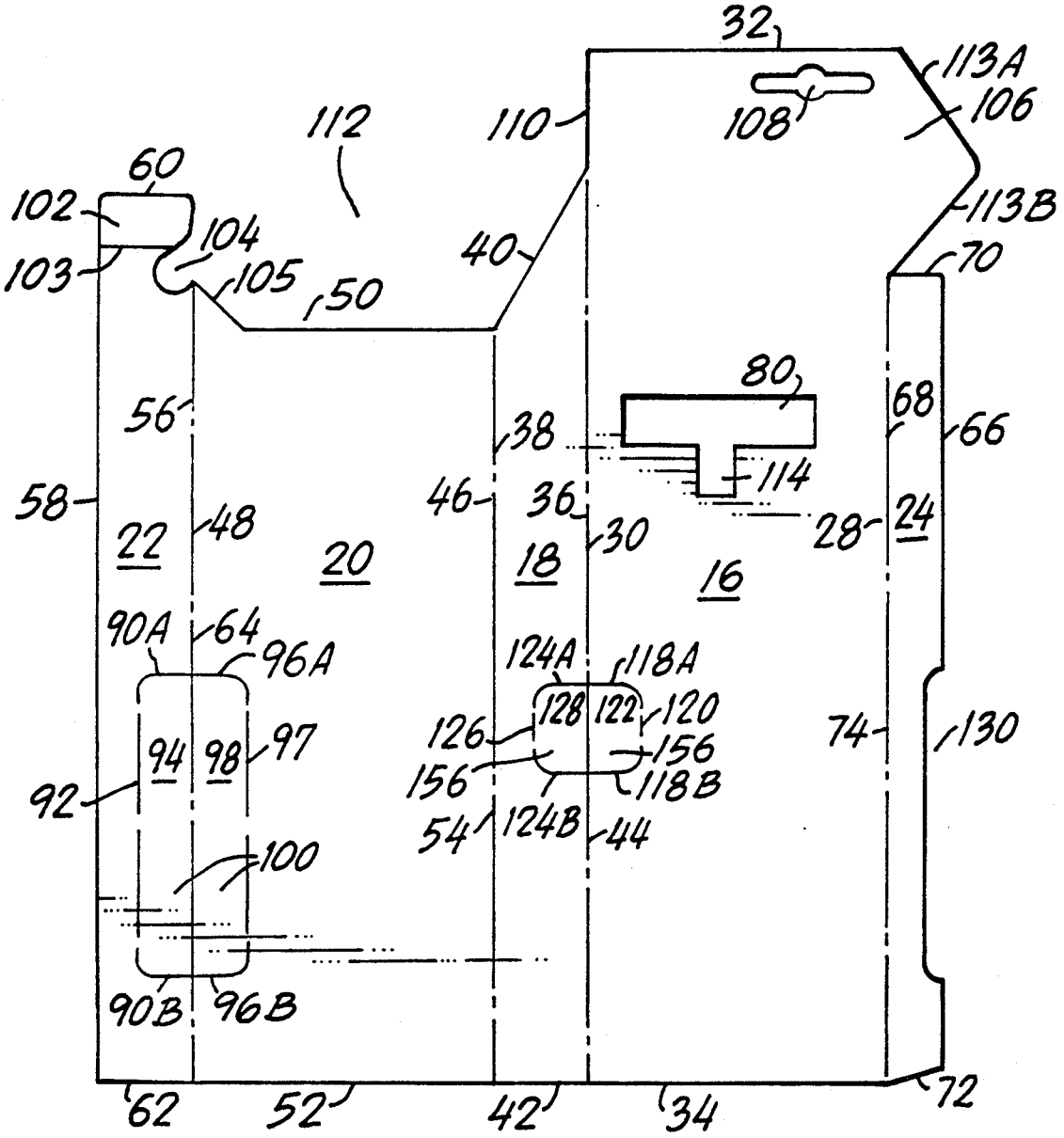
FIG. 1 is a plan view of a starting blank for a package in accordance with the teachings of the present invention.

FIG. 1 illustrates a blank 10 for erection into a package for display, such as the package illustrated in FIGS. 2-11. The description of the package in FIGS. 2-11 is with reference to a mop disassembled into two components including a mop head 12 and a mop handle 14. The mop, however, is illustrative of a particularly preferred use for the blank and a package of the present invention.

Blank 10 is preferably made of a flexible material such as cardboard but may be made of other flexible material. The surfaces shown in the blank of FIG. 1 form the interior surfaces of the erected package. Blank 10 includes a rear wall panel 16, a first side wall panel 18, a front wall panel 20, a second side wall panel 22, and a side flap 24. Rear wall panel 16 has a pair of opposed longitudinal, or lateral, side edges 28 and 30, respectively, and transverse opposed top and bottom edges, 32 and 34, respectively. First side wall panel 18 has a pair of longitudinal, or lateral, side edges 36 and 38, respectively, side edge 36 being connected to side edge 30 of rear wall panel 16 along a common first fold line 44. Panel 18 has an angled top edge 40 and a transverse bottom edge 42 aligned with bottom edge 34 of rear wall panel 16. Front wall panel 20 has a pair of longitudinal, or lateral, side edges 46 and 48, a transverse top edge 50, and a transverse bottom edge 52 aligned with bottom edge 42 of first side wall panel 18. Side edge 46 is connected to side edge 38 of first side wall panel 18 along a common second fold line 54. Second side wall panel 22 has a pair of longitudinal, or lateral, side edges 56 and 58 a top edge 60 and a transverse bottom edge 62 aligned with bottom edge 52 of front wall panel 20. Side edge 56 is connected to side edge 48 of front wall panel 20 along a common third fold line 64. Side flap 24 has a pair of longitudinal, or lateral, side edges 66 and 68, a top edge 70 and a transverse bottom edge 72 connected to the bottom edge 34 of rear wall panel 16 preferably at a slight angle. Side edge 68 is connected to side edge 28 of rear wall panel 16 along a common fourth fold line 74.

Front wall panel 20, first and second side wall panels 18 and 22, and rear wall panel 16 are to be assembled by folding each wall panel about the fold lines 44, 54, and 64, and side flap 24 about fold line 74 with second side wall panel 22 being bonded to the inner side of side flap 24 so as to obtain an erected package 76 such as that shown in FIGS. 2-11, namely, a box forming a compartment 78 having opposed parallel walls in which is positioned mop head 12 and mop handle 14 in the final assembled package 76. Compartment 78 has opposed upper and lower openings 79A and 79B, respectively.

Rear wall panel 16 defines a rectangular aperture 80 positioned transversely off-center relative to side edges 28 and 30 towards side edge 30. Mop handle 14 includes a mop shaft 82 and an angled cylindrical pivot end 84 (FIGS. 2-11), which extends upwardly and outwardly relative to mop handle 14 and at a particular obtuse angle. Mop head 12 includes a mounting member by which mop handle 14 can be connected to mop head 12 by a user to form a complete assembled short mop. The mounting member includes a pair of spaced flanges 86 having aligned cylindrical holes 88 for receiving pivot end 84. Aperture 80 is capable of receiving and holding flanges 86 so that mop head 12 is prevented from lateral movement relative to top and bottom edges 32 and 34 and transverse movement relative to side edges 28 and 30 when mop head 12 and mop handle 14 are positioned in the assembled package 76.

As illustrated in FIG. 1, second side wall panel 22 has a pair of spaced opposed transverse upper and lower cuts 90A and 90B, respectively, extending to fold line 64 and also has another fold line 92 lateral to fold line 64 extending to the ends of cuts 90A and 90B. Cuts 90A and 90B, fold line 92, and fold line 64 form a first rectangular panel section 94. Front wall panel 20 has a pair of spaced opposed transverse upper and lower cuts 96A and 96B, respectively, extending to fold line 64 and also has another fold line 97 lateral to fold line 64 extending to the ends of cuts 96A and 96B. Cuts 96A and 96B, fold line 97 and fold line 64 form a second rectangular panel section 98. First and second rectangular panel sections 94 and 98, which are joined at fold line 64, are rotated, or toggled, inwardly along fold line 64 during the erection process to form a pocket 100 to be formed within compartment 78 of package 76. Mop handle 14 is held between first and second panel sections 94 and 98 within compartment 78 of the assembled package so as to position mop handle 14 against the inner surfaces of front wall panel 20 and second side wall panel 22 in areas other than pocket 100 whereby mop handle 14 is prevented from moving transversely relative to the assembled package, that is, between first and second side wall panels 18 and 22 and between rear and front wall panels 16 and 20. Preferably fold lines 92 and 97 are perforated.

A top flap 102 is connected to side wall panel 22 at a transverse fold line 103. Top flap 102 is tilted along fold line 103 against mop head 12 along fold line 103 at a 45 angle in erected package 76. Second side wall panel 22 defines a notch 104 just below fold line 103 opening toward front wall panel 20 for receiving angled pivot end 84 of mop handle 14 to prevent lateral movement of mop handle 14 relative to assembled package 76, specifically between opposed upper and lower openings 79A and 79B. Top edge 50 of front wall panel 20 includes an upwardly extending top edge 105 which joins top edge 50 with second side wall panel 22 at fold line 64 where notch 104 is located.

Rear wall panel 16 has a top portion 106 including top edge 32 which is spaced from top edge 50 of front wall panel 20. Top portion 106 forms an opening 108 for receiving a hook of a display rack. Top portion 106 has a longitudinal side edge 110 which extends from top edge 40 of first side panel 18 and is aligned with fold line 44 from where it extends to top edge 32. Top edge 40 of first side wall panel 18 joins top edge 50 and side edge 110 at an upward angle. Top portion 106 includes an A-shaped side section 111 oriented transversely outwardly from side edge 28, that is, with the tip of the A oriented away from side edge 110. Upper and lower edges 113A and 113B, respectively, of A-shaped side section 111 are angled from top edge 32 and the top of side edge 28 to meet at the apex of the A. In erected and assembled package 76, lower angled edge 113B is angled upwardly from the horizontal at the same particular angle that angled pivot end 84 is angled from mop shaft 82. Angled pivot end 84 is oriented to lie within the configuration of A-shaped section 111 generally aligned with lower angled edge 113B of A-shaped section 111.

The dimensions of blank 10 are such that when mop head 12 and mop handle 14 are positioned in assembled package 76, rear and front wall panels 16 and 20 and first and second side wall panels 18 and 22 are in contact with portions of mop head 12 and mop handle 14, other portions of which are also in mutual contact.

Figure 3:
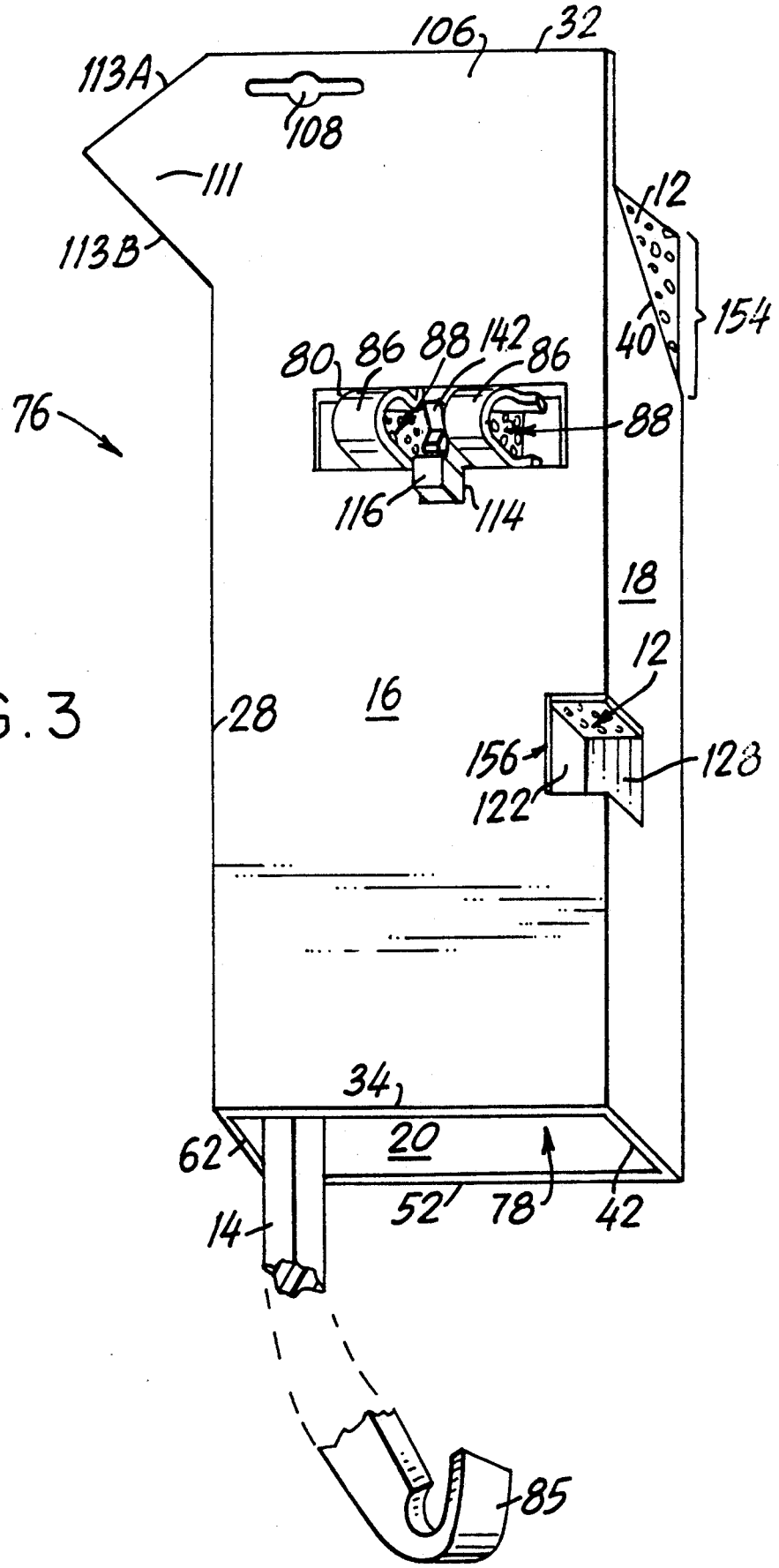
FIG. 3 is a rearward perspective of the package shown in FIG. 2.

The longitudinal distance between top edge 32 of rear wall panel 16 is spaced from (specifically above, in assembled package 76 in the orientation in which it is intended to be displayed) top edge 50 of front wall panel 20 so that a viewing opening 112 is defined between the first and second side wall panels 18 and 22 of assembled package 76 so that a portion of mop head 12 can be viewed. Angled top edge 40 of side wall panel 18 extends upwardly from top edge 50 to side edge 110 of top portion 106 of rear wall panel 16, as shown in FIG. 3. Pivot end 84 of mop handle 14 mounted in notch 104 can also be viewed through opening 112. Mop handle 14 has a length, the distance between top edge 50 bottom edge 52 of front wall panel 20 is less than the shaft length.

Mop head 14 includes a depress button 116 positioned between pair of spaced flanges 86. Rear wall panel 16 forms a second aperture 114 connected to the bottom, that is, the side toward bottom edge 34, of the mid-area of aperture 80, which receives and holds button 116 when mop head 12 is positioned in assembled package 76.

Rear wall panel 16 has a pair of spaced opposed transverse upper and lower cuts 118A and 118B, respectively, extending to fold line 44 and also has another fold line 120 lateral to fold line 44 extending to the ends of cuts 118A and 118BA. Cuts 118A and 118B, fold line 120, and fold line 44 form a first rectangular panel section 122. First side wall panel 18 has a pair of spaced opposed transverse upper and lower cuts 124A and 124B, respectively, extending to fold line 44 and also has another fold line lateral to fold line 44 extending to the ends of cuts 124A and 124B. Cuts 124A and 124B, fold line 126 and fold line 44 form a second rectangular panel section 128, which is mating in size and configuration with first panel section 122. First and second rectangular panel sections 122 and 128, which are joined at fold line 44, are rotated, or toggled, inwardly along fold line 44 during the erection process to form a stop within compartment 78 of assembled package 76 for preventing upward or downward lateral movement of mop head 12 relative to assembled package 76, specifically relative to upper and lower openings 79A and 79B, when mop head 12 is positioned therein. Preferably, fold lines 120 and 126 are perforated.

Side flap 24 defines an elongated cutout 130 opening along side edge 66 so as to avoid interference with second panel section 94 in assembled package 76.

Figure 1A:
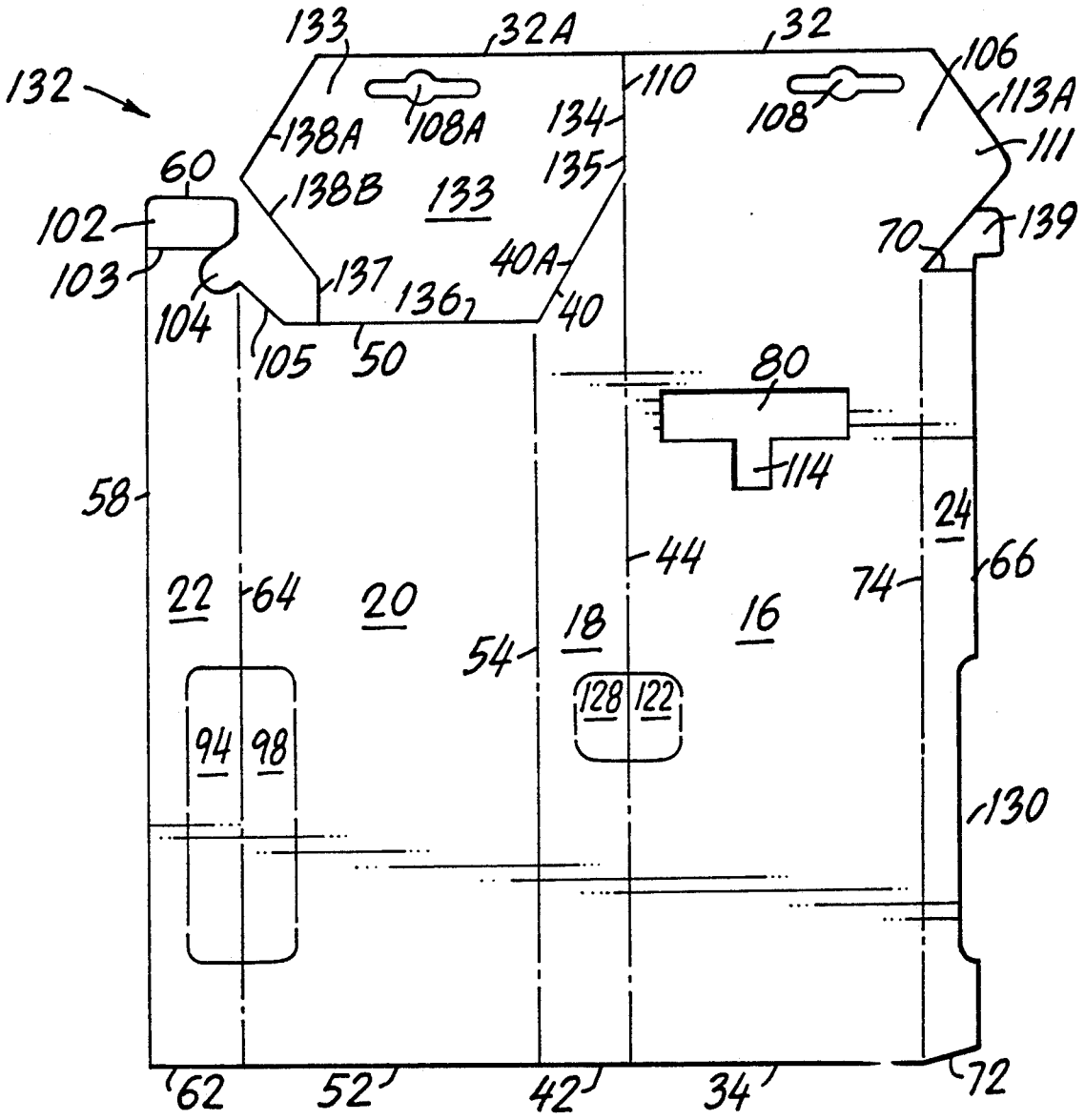
FIG. 1A is a plan view of another embodiment of the starting blank for the package.
Figure 2:
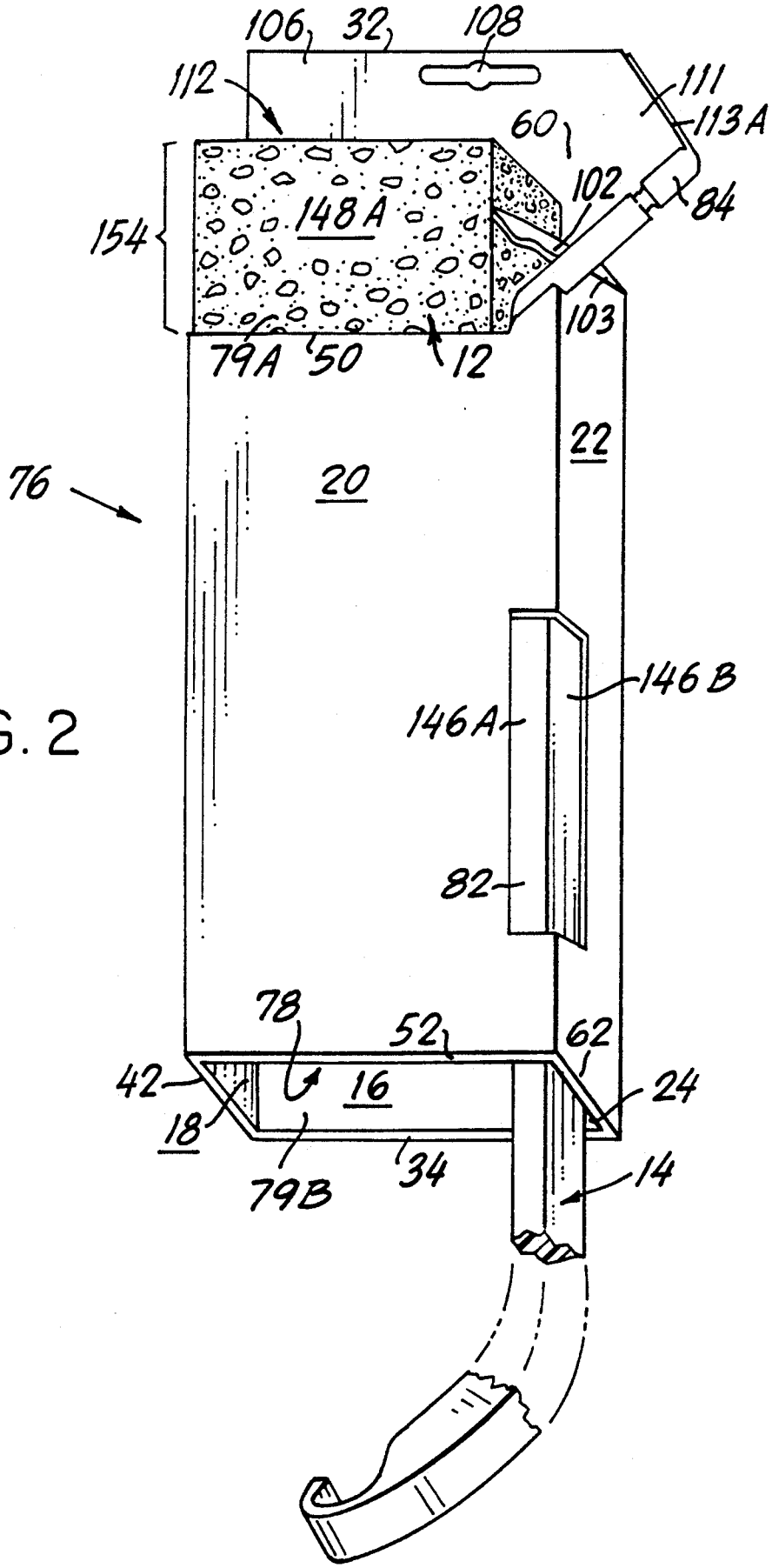
FIG. 2 is a frontal perspective view of a package holding a disassembled mop including a mop head and a mop handle.

Another blank 132 illustrated in FIG. 1A has elements analogous to the elements of blank 10 with rear wall panel 16, first side wall panel 18, front wall panel 20, second side wall panel 22, and side flap 24 being the same for FIG. 1A as for FIG. 1 and so shown with the same numeral indicators. Blank 132 includes mating flap section 133 having a side edge 134 connected to side edge 110 of top portion 106 where a fifth fold line 135 is formed, which in turn is in alignment with first fold line 44; a top edge 32A aligned with and mating with top edge 32 of top portion 106 in the erected package 76; an angled side edge 40A which is directly aligned with angled side edge 40 in blank 132; a transverse bottom edge 136 which is directly aligned with part of top edge 50 of front wall panel 20 in blank 132; a lateral side edge 137 opposed to side edge 40A: an angled side edge 138A extending downwardly and outwardly from top edge 32A and which mates with angled side edge 113A of top portion 106 in erected package 76; and an angled side edge 138B extending downwardly and inwardly from the bottom end of angled side edge 138A and which mates with angled side edge 113B of top portion 106 in erected package 76. Mating flap section 133 is configured to register with observable areas of top portion 106 when mating flap section 133 is folded along fold line 135. Mating flap section 133 defines a second opening 108A for receiving the hook of a display rack, opening 108A being in registry with opening 108. A two-layered section area is thus formed in assembled package 76 for providing extra strength when package 76 is hung from the hook. When the blank is of the type having a finished and an unfinished surface, mating flap 133 also provides a finished surface visible to the prospective purchase, and onto which may be printed product graphics and point of sale information. It is seen that an equivalent construction may be obtained by providing a mating flap having top edge 32 as the fold line common to the mating flap and the top portion 106. This, however, is not preferred because additional blank material would be required.

Blank 132 also illustrates an optional flap 139 which is connected to side flap 24 at a common fold line with side flap 24 at top edge 139. Optional support flap 139 is folded about top edge 70 of side flap 24 to register with and under retention flap 102 at a 45° angle in erected package 76 to give added strength to retention flap 102.

FIGS. 2–11 illustrate a package for display, which includes the erected package 76 of the blank shown in FIG. 1 and having the same elements, which are shown and described herein with the same or similar numerals and general descriptive designations. The two components of the disassembled mop, namely, mop head 12 and mop handle 14 are mounted in the fully assembled package 76. Mop head 12, which for purposes of exposition is illustrated as being a sponge made of a plastic material, includes mounting flanges 86 secured to one of its faces, the flanges having aligned cylindrical holes 88 into which angled cylindrical pivot end 84 is inserted when the full mop is being assembled by a user. Mop handle 14 includes an angled pivot end 84 at one end of mop shaft 82 and a grip 85 angled in a direction opposite to angled pivot end 84 at the opposite end of shaft 82. Depress button 116 provides means to manually depress a biasable finger having a locking detent 142 (FIGS. 3 and 9) at one end and which is located between flanges 86. When cylindrical pivot end 84 is fully into holes 88, button 116 is released and detent 142 is sprung into position by the biasable finger.

Figure 4:
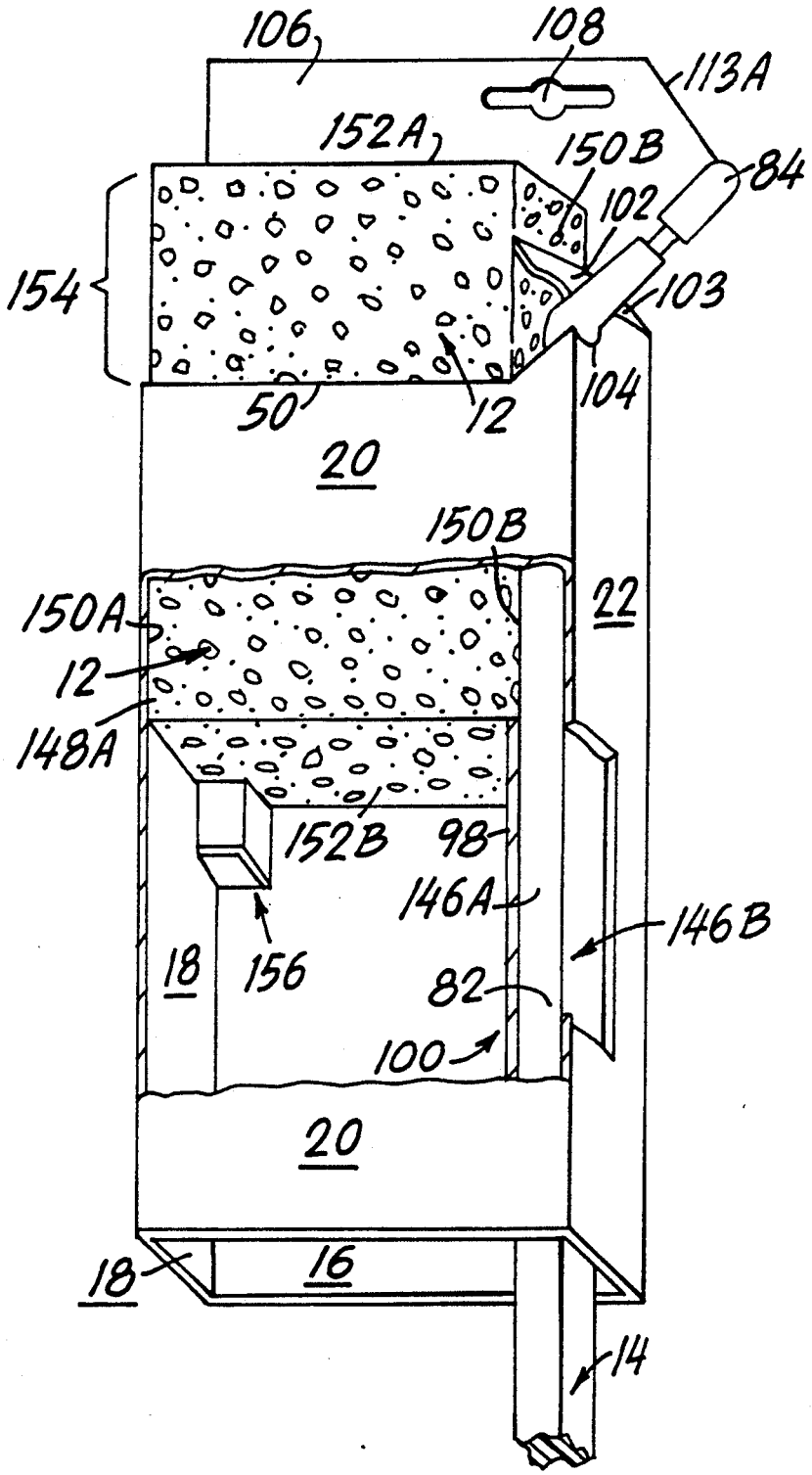
FIG. 4 is a frontal perspective view of the package shown in FIGS. 2 and 3 with a portion of the front wall stripped away.
Figure 5:
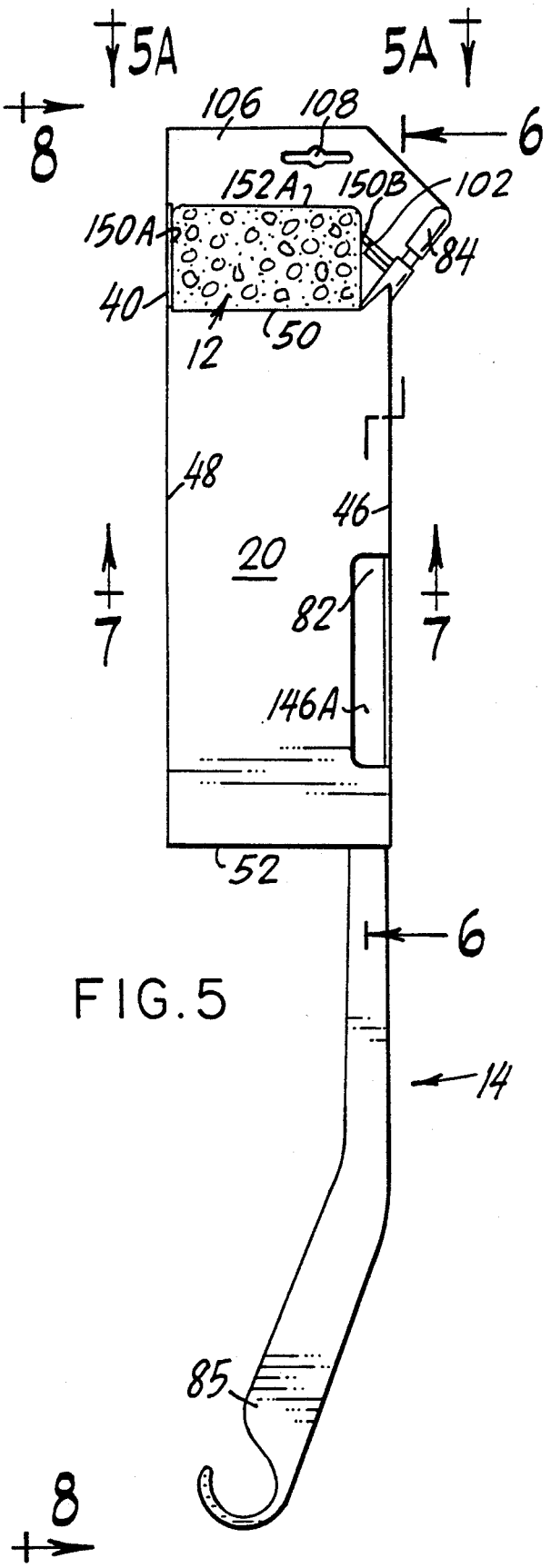
FIG. 5 is front elevational view of the package.
Figure 6:
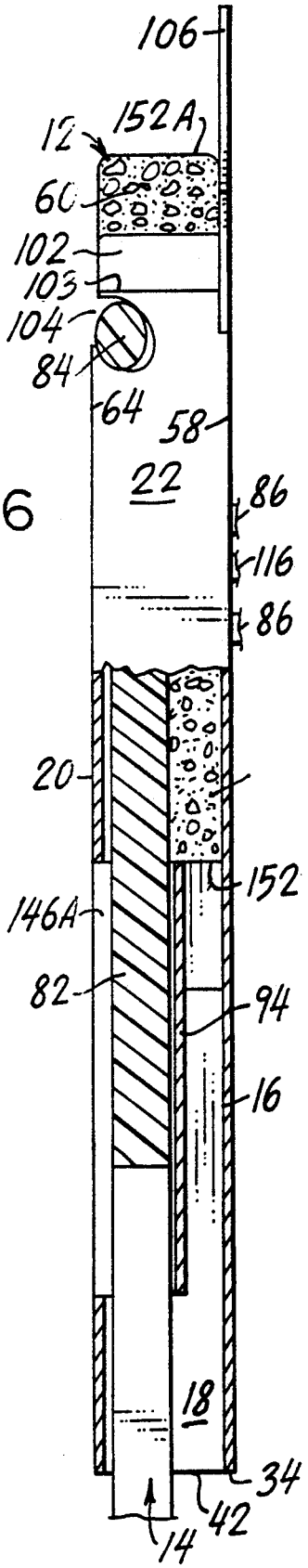
FIG. 6 is a sectional view taken through line 6—6 in FIG. 5.
Figure 8:
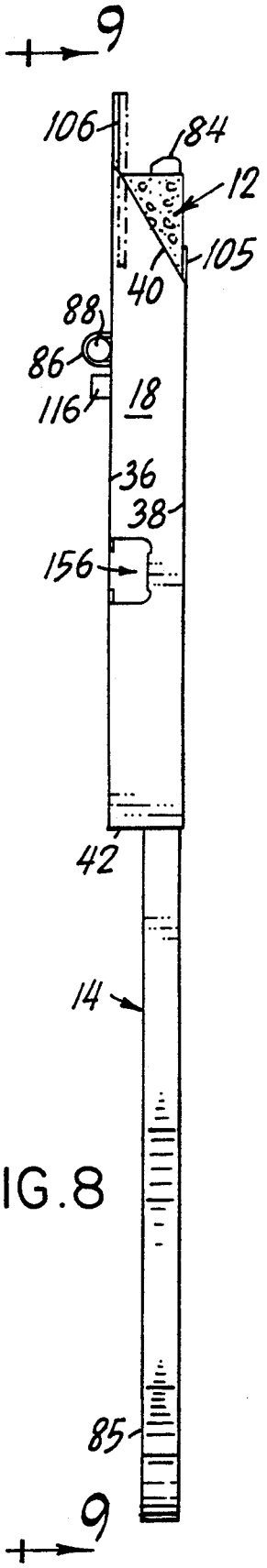
FIG. 8 is a side elevational view of the package taken through line 8—8 in FIG. 5.

Package 76 includes front wall 20, opposed rear wall 16, which are connected to opposed first and second, or left and right, side walls 18 and 22, respectively, which together form compartment 78 in which are positioned mop head 12 and a portion of mop handle 14. Side flap 24 is bonded to the inner surface of second side wall 22 as shown in FIGS. 4, 7, and 11. Package 76 is rectangular in the cross-sections shown in FIGS. 4, 7, and 11 with front and rear walls 20 and 16 being located at a greater distance from one another than are first and second side walls 18 and 22. Rear wall 16 includes top portion 106, which defines opening 108 for receiving a hook of a display rack. Rear wall 16 defines aperture 80 for receiving and holding the mounting flanges 86 of mop head 12 so that mop head 12 is prevented from lateral movement relative to package 76 and specifically between upper and lower openings 79A and 79B and transverse movement relative to side walls 18 and 20. Bottom edges 34, 42, 52, and 62 of rear wall 16, first side wall 18, front wall 20, and second side wall 22, respectively, lie in a plane normal to rear and front walls 16 and 20 and first and second side walls 18 and 22. Rear and front walls 16 and 20 and first and second side walls 18 and 22 have top edges 32, 40, 50, and 60, respectively.

The mounting member of mop head 12 includes second aperture 114 connected to the midway bottom side of first aperture 80. Depress button 116 is positioned in second aperture 114.

A pocket 100 integral with front wall 20 and second side wall 22 is located within compartment 78 and holds a portion of mop shaft 82 in such a manner that the non-held portions of mop shaft 82 are in contact with the inner surfaces of front wall 20 and second side wall 22 with the result that mop handle 14 is substantially prevented from transverse movement relative to front and rear walls 20 and 16 and to first and second side walls 18 and 22. Pocket 100 is defined by first and second joined wall sections 94 and 98, respectively, which are connected to second side wall 22 and front wall 20, respectively, and which are generally parallel to front wall 20 and second side wall 22, respectively. Apertures 146A and 146B are formed in front wall 20 and second side wall 22, respectively, opening to pocket 100 through which mop shaft 82 can be viewed. Pocket 100 extends to a distance sufficient to secure handle 14.

Second side wall 22 at its top end defines a notch 104, which opens toward front wall 20 for receiving angled pivot end 84 wherein mop handle 14 is prevented from lateral movement relative to package 76, that is, up or down movement relative to top or bottom edges 60 or 62 of second side wall 22 or between upper and lower openings 79A and 79B. A retention flap 102 tilts at a fold line 103 of side wall 22 which is coextensive with the top edge of second side wall 22. Retention flap 102 is folded at a 45° angle against sponge head 12 in a lock position. Retention flap 102 presses against mop head 12 and thus locks into position so as to prevent lateral, or vertical, movement of handle 14 relative to openings 79A and 79B. An optional support flap 139 as discussed in relation to blank 132 and illustrated in FIG. 1A is connected to the top of side flap 24. Flap 139 registers with and is positioned under top flap 102 as shown in phantom line in FIG. 5. Retention flap 102 can be optionally bonded to support flap 139.

Parallelepiped mop head 12 has a pair of front and rear sides 148A and 148B, respectively, and a pair of opposed left and right sides 150A and 150B, respectively, and a pair of opposed top and bottom sides 152A and 152B, respectively. The inner surfaces of front and rear walls 20 and 16 and second side wall 22 of package 76 are in contact with front and rear sides 148A and 148B and left side 150A, respectively. Right side 150B is in contact with the surface of mop shaft 82 in the area immediately above pocket 100 so that mop head 12 and mop shaft 82 are each prevented from lateral and transverse movement relative to package 76. Right side 150B is also in contact with retention flap 102.

Top edge 32 of rear wall 16 is spaced from, specifically above, top edge 50 of front wall 20 to define between first and second side walls 18 and 22 viewing opening 112. An upper portion 154 of mop head 12 extends beyond top edge 50 so that portion 154 can be viewed.

Shaft 14 has a length, the distance between top and bottom edges 50 and 52 of front wall 20 is less than the shaft length so that a portion of shaft 14 extends beyond bottom edge 50.

A stop member 156 integral with rear wall 16 and side wall 18 is located within compartment 78 and prevents downward movement of mop head 12 relative to package 76. Stop member 156 is formed by a generally square panel 122 connected to rear wall 16 at a right angle and a generally square second panel joined to panel 122 at a right angle and to side wall 18 at a right angle. The top sides of panels 122 and 128, namely, 118A and 124A, respectively, are in contact with bottom wall 152B of mop head 12 so that mop head 12 is prevented from sliding downwardly. It is preferred that upper edges 118A and 124A of stop 156 are in the same transverse plane as top edges 90A and 96A of pocket 100.

Figure 9:
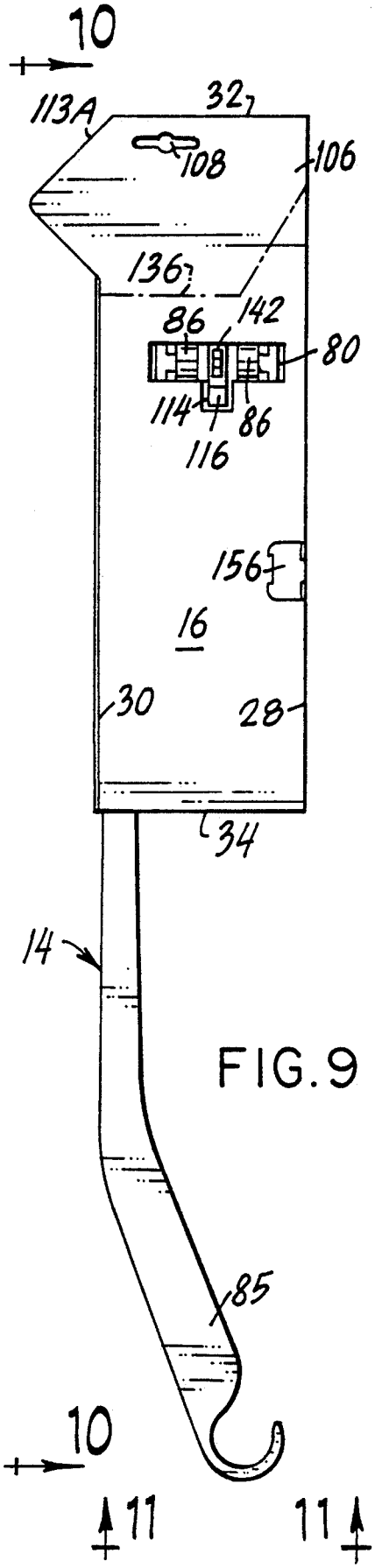
FIG. 9 is a rear elevational view of the package taken through line 9—9 in FIG. 8.

A package analogous to package 76 can be erected using blank 132 as shown in FIG. 1A. Such a package would have a double ply, or double thickness, for upper portion 106. Such a double wall is shown in phantom line in FIG. 8 as indicated by top wall portion 158, which mates with top portion 106 along top edge 32, side edge 110, and upper and lower angled edges 113A and 113B. Bottom edge 136 and angled side edge 40A, illustrated in FIG. 1A, are shown in FIG. 9 in phantom line.

In the preferred embodiment, the mop handle is received by the pocket and the mop head is received by the compartment, the mop head being in cooperative abutting relationship with the front, rear and first side walls and with a portion of the mop handle. The portion of the mop handle received by the pocket is in further cooperative relationship with the front and second side walls. Such abutting cooperative relationships, together with the engagement of the mounting means 86 in the rear wall aperture and the engagement of the mop handle by the notch 104, substantially prevent transverse and lateral movement of the mop head and mop handle relative to the package.

Blanks 10 and 132 are shown with inner surfaces facing upwardly and outer surfaces facing downwardly. The outer surfaces of blanks 10 and 132 are shown in FIGS. 2–11 as the external surfaces of the assembled packages, e.g., package 76 in FIG. 2. The outer surfaces can be finished surfaces in a manner known in the art of preparation of packaging cardboard, and the inner surfaces are generally unfinished surfaces.

The process of erecting package 76 from blank 10 is in accordance with the following steps:

1. Folding rear wall panel 16 about first fold line 44, first side wall panel 18 about first and second fold lines 44 and 54, front wall panel 20 about third and fourth fold lines 64 and 74 each toward one another until panels 16 and 20 are parallel and panels 18 and 22 are in planes normal to the planes of panels 16 and 20;

2. Folding side flap about fourth fold line 74 inwardly toward rear wall panel 16 and placing side flap against the inner surface of second side wall 22; and 3. Bonding side flap 24 to the inner surface of second side wall 22.

When blank 132 is used to assemble a package, the following step is added:

4. Rotating mating flap section 134 along fifth fold line 136 until it registers with top portion 106; and 5. Bonding mating flap section 134 to top portion 106.

The process of assembling mop head 12 and mop handle 14 of the disassembled short mop with erected package 76 is in accordance with the following steps:

1. Inserting handle 14 through the bottom side of compartment 78 with angled pivot end 84 being inserted into pocket 100 with the angle thereof being directed inwardly and passed therein to notch 104 whereupon handle 14 is rotated so that angled pivot end 84 is oriented toward notch 104 and positioning of angled pivot end 84 in notch 104 so that angled pivot end 84 is generally aligned with the bottom edge of A-shaped portion 111 of top portion 106 of rear wall 16.

2. Inserting mop head 12 into the top side of compartment 78 with the long dimension oriented between first and second side walls 18 and 22 and the short dimension oriented between rear and front walls 16 and 20 with the mounting member, that is, pair of flanges 86 and depress button 116 are oriented against the inner surface of rear wall 15;

3. Further inserting mop head 12 downwardly into compartment 78 until flanges 86 are locked into place in apertures 80 and shaft 14 comes into contact with first and second wall sections 94 and 98 of pocket 100;

4. Wherein simultaneously with step 3, bottom side 152B of mop head 12 is positioned against stop 156; and 5. Wherein simultaneously with step 3, depress button 116 is locked into place in second aperture 114.

Although the present invention has been described in some detail by way of illustration and example for purposes of clarity and under standing, it will, of course be understood that various changes and modifications may be made in the form, details, and arrangements of the parts without departing from the scope of the invention set forth in the following claims.

What is claimed is

1. A blank for erection into a package for holding an essentially rectangular first component and a generally elongate second component, the blank comprising:

a rear panel;

a first side panel;

a front panel having a top edge;

a second side panel having a top edge, and a side flap panel;

each of said panels being laterally, adjacently connected one to the other to form a first lateral fold line between the rear and first side panels, a second lateral fold line between the first side and front panels, a third lateral fold line between the front and second side panels, and a fourth lateral fold line between the rear and side flap panels, the second side and side flap panels each having a free lateral edge, the package being formable about said lateral fold lines to define a compartment having opposed openings with the second side panel being superpositionally bonded to the side flap panel;

said second side panel having a pair of transverse opposed cuts extending to said third fold line and a first short fold line lateral to said third fold line extending to the ends of said pair of cuts, said pair of cuts and said third fold line and said short fold line forming a first rectangular panel section; said front panel having a pair of transverse opposed cuts extending to said third fold line and a second short fold line lateral to said third fold line extending to the ends of said pair of cuts, said pair of cuts and said third fold line and said second short fold line forming a second rectangular panel section, said first and second rectangular panel sections being joined at said third fold line and capable of forming pocket means within the compartment of the erected package;

whereby in the erected package the second component is receivable by the pocket and the first component is receivable by the compartment, the first component being in cooperative abutting relationship with the first side, front and rear panels and the second component, and the second component being in further cooperative abutting relationship with the front and second side panels, such abutting cooperative relationships substantially preventing transverse and lateral movement of the components relative to the erected package.

2. The blank according to claim 1, wherein the rear panel has an aperture adapted to receive first component retention means, whereby the first component is further prevented from lateral movement relative to said opposed openings and transverse movement relative to the first and second side panels when positioned in the compartment of the erected package.

3. The blank according to claim 1, wherein the second side panel includes means proximate its top edge to further retain the second component in lateral movement-free relationship relative to the erected package.

4. The blank according to claim 1, wherein said rear panel has a top portion including a top edge of said rear panel, the top portion being spaced above the top edge of said front panel.

5. The blank according to claim 4, wherein the top portion has an opening for receiving a hook of a display rack.

6. The blank according to claim 3 wherein said means to retain the second component is a shaped portion of the second panel in the form of a notch adapted to receive a transverse section of the second component.

7. The blank according to claim 6 further including an upwardly extending retention flap having a top edge and connected to said second side panel top edge along a coextensive fold line, said retention flap top edge adapted for angled engagement with said first component in the erected package.

8. The blank according to claim 7 wherein the rear panel has an aperture adapted to receive the first component retention means, whereby the first component is further prevented from lateral movement relative to said opposed openings and transverse movement relative to the first and second side panels when positioned in the other compartment of the erected package.

9. The blank according to claim 8 wherein the first component is a mop head and the second component is a mop handle, the mop head and handle adapted for assembly to form a short mop, the mop head having mop handle connection means including said retention means receivable by the rear panel aperture, said mop handle being receivable by the notch of the second panel.

10. The blank according to claim 9, wherein said rear panel has a top portion including a top edge of said rear panel, the top portion being spaced above the top edge of the front panel, said top portion including an opening for receiving a hook of a display rack.

11. The blank according to claim 7, further including a support flap connected to the top edge of said side flap panel at a coextensive fold line, said support flap registrable about said fold line with and under said retention flap in the erected package.

12. The blank according to claim 10, further including a mating flap section connected to said top portion of said rear panel along a fifth fold line, said mating flap being configured to register with said top portion when said mating flap is folded along said fifth fold line, said mating flap including an opening for registration with said rear panel top portion opening.

13. The blank according to claim 9, wherein said rear panel has a pair of parallel opposed cuts transverse and extending to said first fold line and has a first short fold line lateral to said first fold line, said pair of cuts, said first fold line and said first short folding line forming a first rectangular panel area; and wherein said first side panel has a pair of parallel opposed cuts transverse and extending to said first fold line and has a second short folding line lateral to said first fold line, said pair of cuts, said first fold line and said second short folding line forming a second rectangular panel area, said first and second rectangular panel areas being joined at said first fold line to form stop means within the erected package for further preventing downward lateral movement of the mop head relative to the erected package when the mop head is positioned in the erected package.

14. A package holding a two-component product including an essentially rectilinear first component and an elongate second component, comprising a front wall and an opposed rear wall;

opposed first and second side walls joined to said front and rear walls;

said front, rear, and first and second side walls defining a compartment having opposed openings, the compartment adapted for receiving the rectilinear component, and pocket means within the compartment and integral with said front and second side walls, the pocket means adapted for receiving a portion of the elongate component, whereby when the second component is received by the pocket and the first component is received by the compartment, the first component is in cooperative abutting relationship with the first, front and rear side walls and a portion of said second component, and the second component is in further cooperative abutting relationship with the front and second side walls, such abutting cooperative relationships substantially preventing transverse and lateral movement of the components relative to the package.

15. The package according to claim 14, wherein the rear wall has an aperture adapted to receive first component retention means, whereby the first component is further prevented from lateral movement relative to said opposed openings and transverse movement relative to the first and second side walls when positioned in the compartment of the package.

16. The package according to claim 14, wherein the second side wall includes means proximate its top edge to further retain the second component in lateral movement-free relationship relative to the package 17. The package according to claim 16, wherein said means to retain the second component is a shaped portion of the second side wall in the form of a notch adapted to receive a transverse section of the second component.

18. The package according to claim 17 further including an upwardly extending retention flap having a top edge connected to the second side wall top edge along a coextensive fold line, said flap top edge adapted for angled abutting engagement with said first component.

19. The package according to claim 14, wherein said rear side wall includes a top portion extending above said front wall, and includes an opening for receiving a hook of a display rack.

20. The package according to claim 14 adapted to hold as the first component a mop head and as the second component a mop handle.

21. A package for holding a disassembled mop including a mop head having mounting means and a mop handle having joinder means at one end for connection to the mounting means to make an assembled mop, comprising a front wall and an opposed rear wall;

opposed first and second side walls joined to said front and rear walls;

said front, rear, and first and second side walls defining a compartment having opposed openings, the compartment adapted for receiving at least a portion of the mop head:

said rear wall defining aperture means adapted to receive and hold the mounting means of the mop head, and pocket means within the compartment and integral with said front and said second side walls, the pocket means adapted for receiving at least a portion of the mop handle, said second side wall having notch means proximate its top edge and opening toward said front wall for receiving a transverse section of the mop handle, whereby, when the mop handle is received by the pocket and the mop head is received by the compartment, the mop head is in cooperative abutting relationship with the front, rear and first side walls and with a portion of said mop handle, and said portion of the mop handle received by the pocket is in further cooperative relationship with the front and second side walls, such abutting cooperative relationships, together with the engagement of the mounting means in the rear wall aperture and the engagement of the mop handle transverse section by the notch, substantially preventing transverse and lateral movement of the mop head and mop handle relative to the package.

22. The package according to claim 21 further including an upwardly extending retention flap having a top edge connected to said second side wall top edge along a coextensive fold line, said retention flap top edge adapted for angled abutting engagement with said mop head.

23. The package according to claim 22, wherein said second side wall has an inner side, and further including a side flap laterally connected to the rear wall and having a top transverse edge, said side flap being bonded to said inner side of said second side wall and also including a support flap connected to said side flap top edge, said support flap being positioned in registry with said retention flap.

24. The package according to claim 21, wherein said rear wall includes a top portion having opening means for receiving a hook of a display rack.

25. The package according to claim 24, wherein said compartment receives a major portion of the mop head, the minor portion extending above the front wall but below the top portion of the rear wall.

26. The package according to claim 25, wherein a section of the mop handle proximate the joinder means would extend from the mop handle at a particular angle and outwardly relative to the second side wall, and wherein said rear wall top portion includes a side section oriented transversely outwardly relative to said second side wall, said side section having an angled edge extending upwardly from said second side wall at the same angle as the particular angle, whereby said mop handle section is generally in alignment with said angled edge when the mop handle is positioned in the package.

27. The package according to claim 24 wherein said rear wall includes a mating flap section connected to the rear wall top portion along a fold line, said mating flap being folded along said fold line and superpositionally bonded to said top portion of the rear wall, said mating flap having an opening for registration with the opening in said top portion.

28. The package according to claim 21, further including second pocket means within the compartment and integral with said rear wall and said first side wall, the second pocket means adapted for abutting the mop head to substantially prevent downward movement thereof.

* * * * *